US007121956B2

(12) United States Patent
Lo

(10) Patent No.: US 7,121,956 B2
(45) Date of Patent: Oct. 17, 2006

(54) GOLF CLUB HEAD WITH WEIGHT MEMBER ASSEMBLY

(75) Inventor: Lai-Fa Lo, Taoyuan (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 152 days.

(21) Appl. No.: 10/972,399

(22) Filed: Oct. 26, 2004

(65) Prior Publication Data

US 2006/0089206 A1 Apr. 27, 2006

(51) Int. Cl.
*A63B 53/06* (2006.01)

(52) U.S. Cl. ..... 473/335; 473/341

(58) Field of Classification Search ..... 473/324–350
See application file for complete search history.

(56) References Cited

U.S. PATENT DOCUMENTS 1,518,316 A * 12/1924 Ellingham ..... 473/337
3,606,327 A * 9/1971 Gorman ..... 473/297
4,052,075 A * 10/1977 Daly ..... 473/338
5,429,356 A * 7/1995 Dingle et al. ..... 473/251
5,571,053 A * 11/1996 Lane ..... 473/336
6,524,198 B1 2/2003 Takeda
6,773,360 B1 * 8/2004 Willett et al. ..... 473/334

FOREIGN PATENT DOCUMENTS

GB 1387955 A * 3/1975
JP 2001000606 A * 1/2001

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP.

(57) ABSTRACT

A golf club head includes a body including at least one compartment, at least one positioning member removably mounted in the at least one compartment, at least one weight member mounted in at least one the positioning member, and at least one retaining member for retaining the at least one weight member in the at least one positioning member. The weight member is concealed in the compartment of the body to provide a good appearance while simplifying polishing procedure and allowing easy replacement of the weight member.

19 Claims, 7 Drawing Sheets

GOLF CLUB HEAD WITH WEIGHT MEMBER ASSEMBLY

BACKGROUND OF THE INVENTION

1. Field of the Invention

The present invention relates to a golf club head. In particular, the present invention relates to a golf club head with a weight member assembly.

2. Description of Related Art

U.S. Pat. No. 6,524,198 discloses a club head comprising a face shell member with a face formed thereon, a sole and peripheral-side shell member with a sole and peripheral side portion formed thereon, and a crown shell member. Inside the sole is provided a balance weight member for enlarging a sweet area on the face by shifting the center of gravity of the head backwards. An opening is defined through the sole and has an edge rising upward, thus caulking the balance weight member, while the edge has an upper end anchored by a stepped portion provided between a lower portion and an upper portion of the balance weight member. A mixture of gluing agent and metal powder is filled into a clearance between an outer peripheral surface of the lower portion- of the balance weight member and an inner peripheral surface of the edge.

The balance weight member is reliably fixed on the sole of the club head. The balance weight member and the club head are generally made of different materials. In some cases, high-cost brazing is carried out for bonding the balance weight member and the club head, resulting in a brazing bead on the club head and thus adversely affecting the appearance of the sole of the club head. Further, the balance weight member could not be changed according to the user's need, which is also the case that the balance weight member is bonded to the club head by adhesive.

OBJECTS OF THE INVENTION

An objective of the present invention is to provide a club head with a weight member assembly, wherein the weight member is concealed in a body of the club head to provide a good appearance.

Another objective of the present invention is to provide a club head with a weight member assembly that allows easy replacement of the weight member.

SUMMARY OF THE INVENTION

In accordance with an aspect of the present invention, a golf club head comprises a body including at least one compartment, at least one positioning member removably mounted in the at least one compartment, at least one weight member mounted in at least one the positioning member, and at least one retaining member for retaining the at least one weight member in the at least one positioning member. The weight member is concealed in the compartment of the body to provide a good appearance while simplifying polishing procedure and allowing easy replacement of the weight member.

In an embodiment of the invention, the body is an iron club head body including a back cavity, and the compartment is defined in a sole delimiting the back cavity.

In another embodiment of the invention, the body is a wooden club head body including an inner space, and the compartment is defined in a sole delimiting the inner space.

In an embodiment of the invention, the weigh member includes an axial hole having an enlarged section, and the retaining member is received in the enlarged section.

The retaining member may be made of a material the same as that of the body.

In an embodiment of the invention, the positioning member includes a head for sealing the compartment of the body. The head of the one positioning member includes at least one driving portion for driving the positioning member for mounting the positioning member into the compartment or removing the positioning member from the compartment.

The positioning member comprises a shank including a first threaded section and a second threaded section. The retaining member includes a screw hole for threadedly engaging with the first threaded section. The compartment includes a threaded section for threadedly engaging with the second threaded section of the positioning member. The first threaded section has a lead different from that of the second threaded section. The first threaded section has a diameter greater than that of the second thread section.

In another embodiment of the invention, the weight member further includes at least one resilient member fixed in an outer periphery of the weight member and pressing against an inner periphery delimiting the compartment for avoiding generation of odd sounds during striking.

In a further embodiment of the invention, the club head further comprises at least one resilient washer sandwiched between the retaining member and an end face delimiting the compartment.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
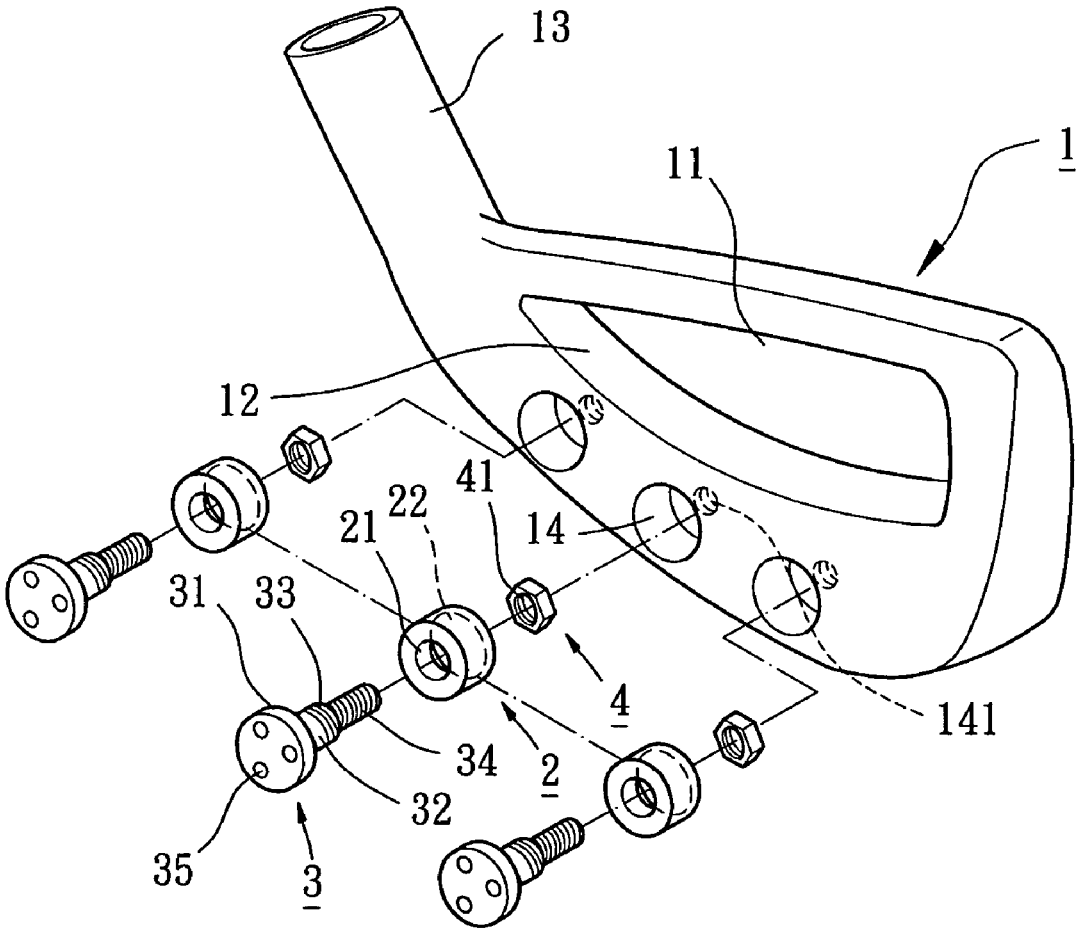
FIG. 1 is an exploded perspective view of a first embodiment of a club head with a weight member assembly in accordance with the present invention.
Figure 2:
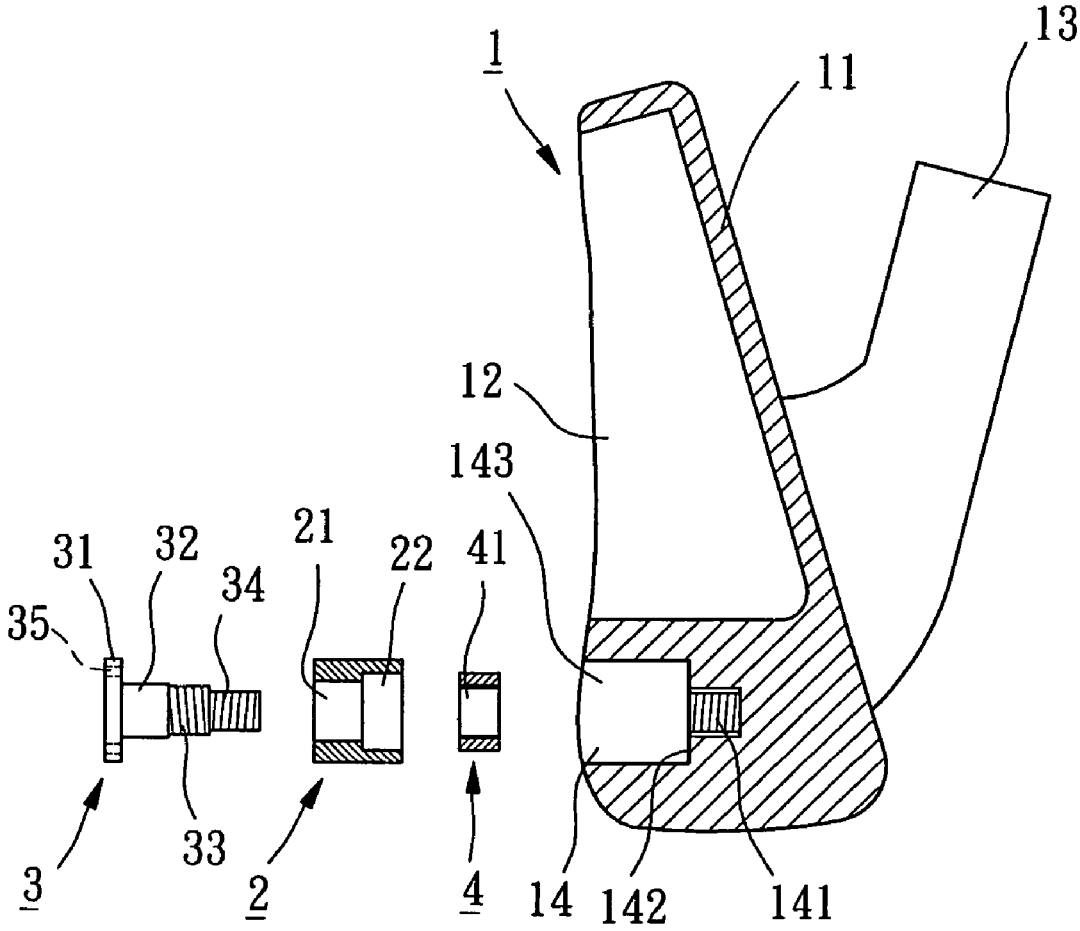
FIG. 2 is an exploded sectional view of the club head in FIG. 1.
Figure 3:
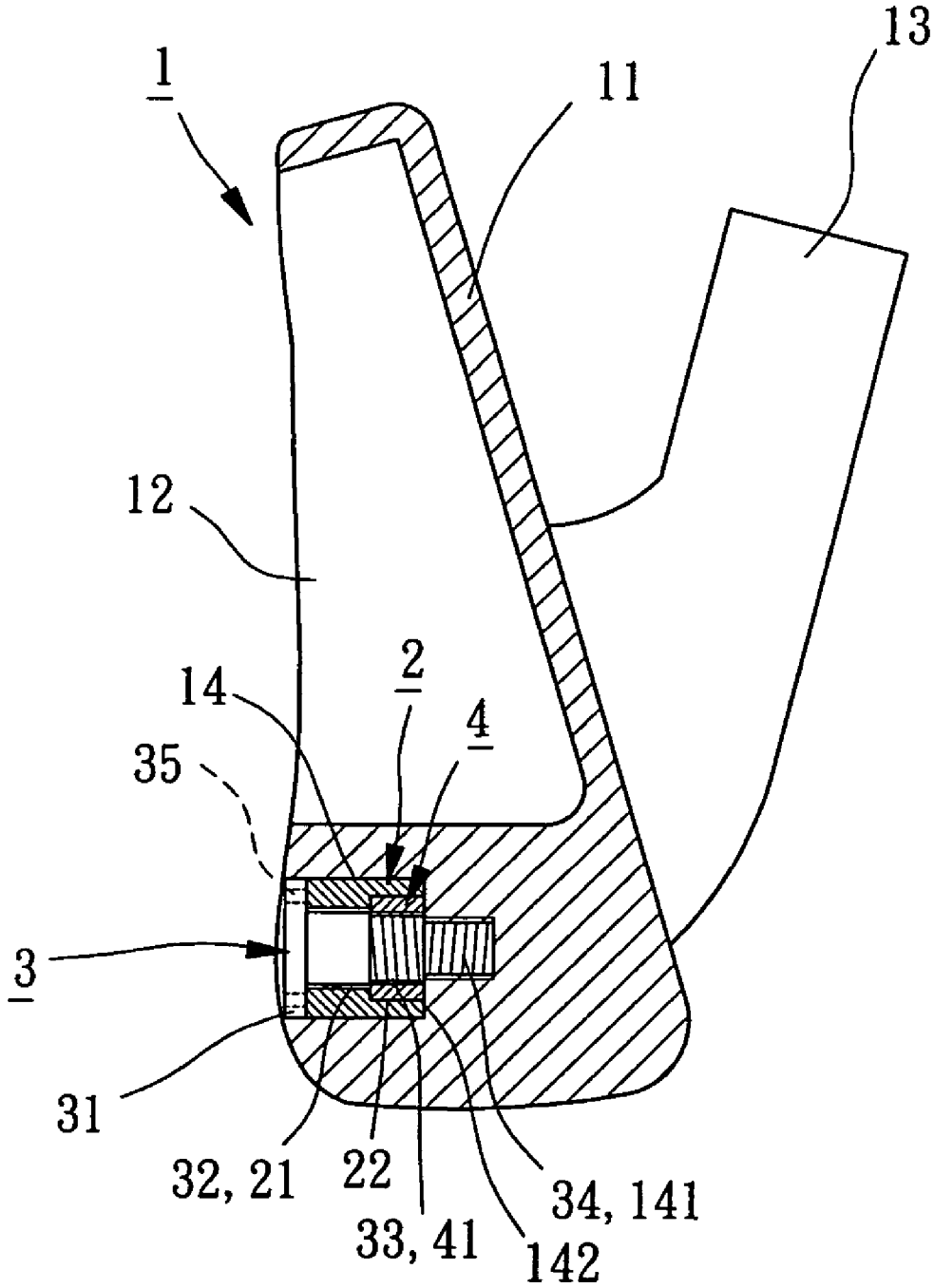
FIG. 3 is an enlarged sectional view of the club head in FIG. 1.

Referring to FIGS. 1 through 3, a first embodiment of a club head with a weight member assembly in accordance with the present invention comprises a body 1, at least one weight member (three in this embodiment) 2, at least one positioning member (three in this embodiment) 3, and at least one retaining member (three in this embodiment) 4.

The body 1 is an iron club head body and made of lighter metal or alloy material, such as stainless steel, alloy steel, or low-carbon steel.

The body 1 includes a striking face 1, a back cavity 12, a hosel 13, and at least one compartment 14 (three in this embodiment). The striking face 11 is formed on a front side of the body 1 for striking a golf ball. The back cavity 12 is located behind the striking face 11, providing a buffering space for elastic deformation of the striking face 11. The hosel 13 is formed on a side of the body 1 for engaging with a shaft (not shown).

The compartments 14 are preferably cylindrical and defined in a sole delimiting the back cavity 12 of the body 1. Each compartment 14 faces rearward and includes a relatively larger outer section 143 and a relatively smaller inner section 141, forming a shoulder 142.

Still referring to FIGS. 1 and 2, each weight member 2 is made of heavier metal or alloy material, such as W—Fe—Ni alloy. Each weight member 2 is cylindrical and includes an outer diameter that is substantially the same as a diameter of the relatively larger outer section 143 of the associated compartment 14. Each weight member 2 includes an axial hole 21 with an enlarged section 22.

Each positioning member 3 is made of a material the same as that of the body 1. Each positioning member 3 includes a head 31 and a shank 32 extending from a side of the head 31. The shank 32 includes a first threaded section 33 and a second threaded section 34 having a diameter smaller than that of the first threaded section 33. The head 31 includes at least one driving portion 35 (a circular hole in this embodiment). The first threaded section 33 has a lead different from that of the second threaded section 34. Each retaining member 4 is a nut having a screw hole 41.

As illustrated in FIGS. 2 and 3, in assembly, each weight member 2 is mounted on the shank 32 of the associated positioning member 3 and abuts the side of the head 31 from which the shank 32. The shank 32 is received in the axial hole 21 of the weight member 2. The first threaded section 33 is received in the enlarged section 22 of the axial hole 21 of the weight member 2, and the second threaded section 34 is outside the weight member 2. An associated retaining member 4 is mounted into the enlarged section 22 of the axial hole 21 of the weight member 2 and threadedly engaged with the first threaded section 33 of the positioning member 3. Thus, the positioning member 3 and the retaining member 4 of the same specification can be used with weight members 2 of the same specification yet of various weights.

As illustrated in FIG. 3, in a further assembling step, the combined positioning member 3/weight member 2/retaining member 4 is mounted into an associated compartment 14. A tool is inserted into the driving portion 35 to turn the combined positioning member 3/weight member 2/retaining member 4 until the second threaded section 34 of the positioning member 3 is threadedly engaged with the relatively smaller threaded section 141 of the compartment 14, with an end face of the weight member 2 and an end face of the retaining member 4 tightly pressing against the shoulder 142 and with an outer periphery of the weight member 2 in intimate contact with the inner periphery of the relatively larger section 143 of the compartment 14.

The head 31 of each positioning member 3 seals the associated compartment 14 after assembly, as illustrated in FIG. 3, providing a club head with concealed and removable weight members 2. In other words, the weight members 2 can be replaced with desired ones according to different user's needs. Further, the positioning members 3 are screwed into the compartment 14 of the body 1, providing a good appearance while simplifying the polishing procedure.

When replacement of the weight member 2 is required, the positioning member 3 is turned at the driving portion 35, allowing subsequent removal of the combined positioning member 3/weight member 2/retaining member 4, which is then dismantled to allow replacement of the weight member 2. Since the first and second threaded sections 33 and 34 have different leads, the weight member 2 would not get stuck in the compartment 14 and the retaining member 4 would not fall from the positioning member 3 during removal of the combined positioning member 3/weight member 2/retaining member 4. Thus, the weight member assembly can be easily and quickly mounted to or detached from the body 1 while allowing easy replacement of the weight member(s) 2.

Figure 4:
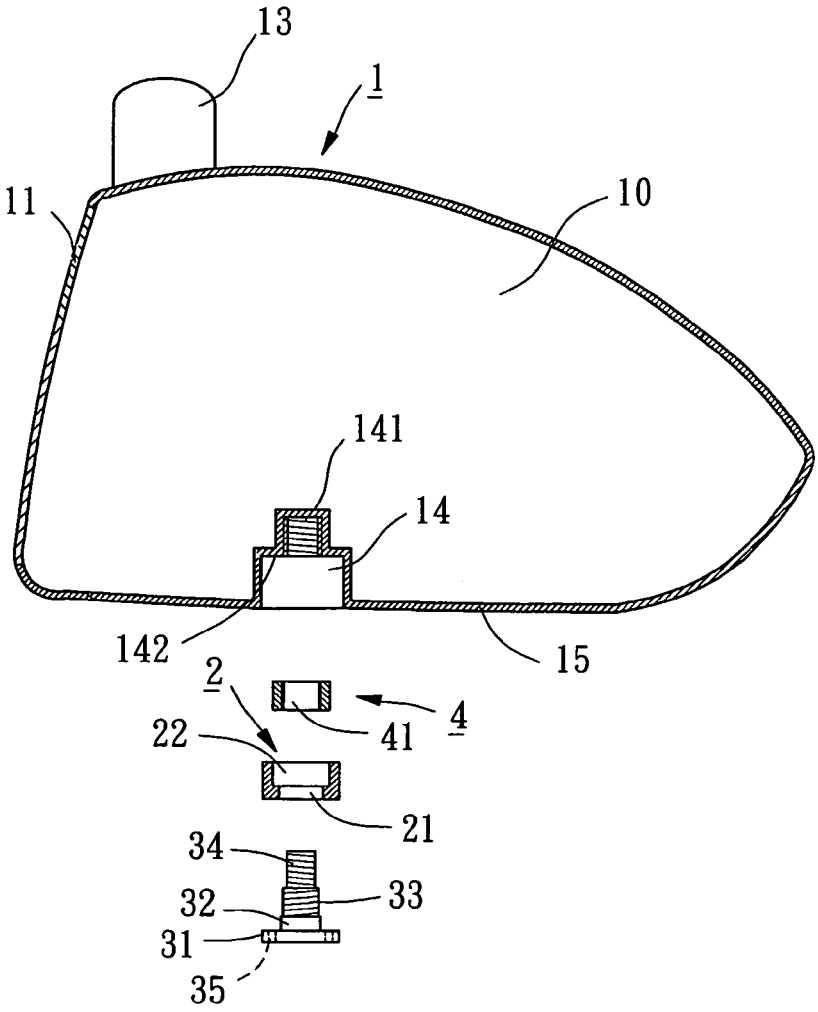
FIG. 4 is an exploded sectional view of a second embodiment of the club head in accordance with the present invention.
Figure 5:
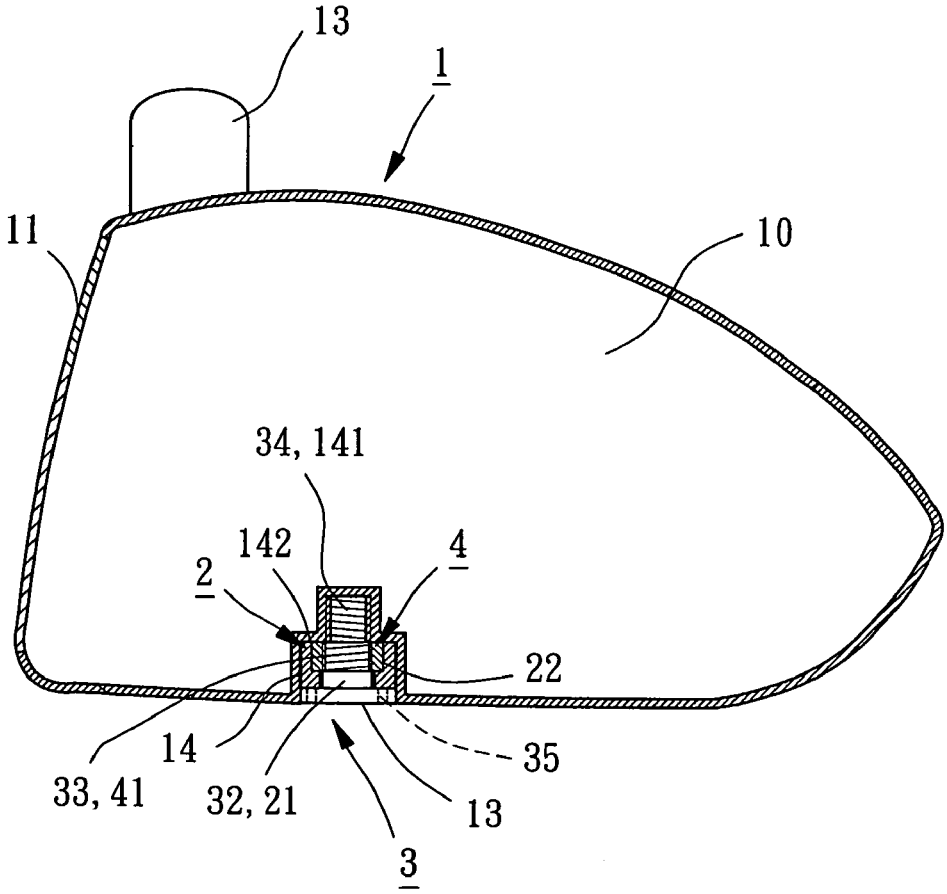
FIG. 5 is a sectional view of he club head in FIG. 4.

FIGS. 4 and 5 illustrate a second embodiment of the invention, wherein the body 1 is a wooden club head body. The only difference between this embodiment and the first embodiment is that only one downwardly facing compartment 14 is defined in a sole 15 delimiting an inner space 10 defined in the body 1 and that only one set of positioning member 3/weight member 2/retaining member 4 is provided.

Figure 4A:
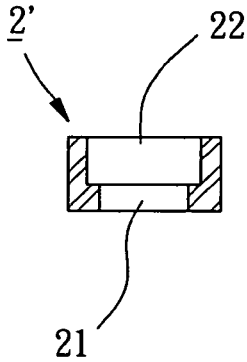
FIG. 4A is a sectional view of a modified embodiment of a weight member of the club head in accordance with the present invention.
Figure 4B:
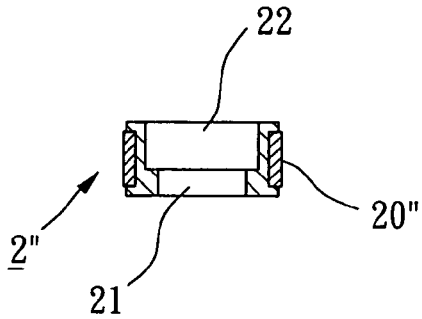
FIG. 4B is a sectional view of another modified embodiment of the weight member of the club head in accordance with the present invention.

FIG. 4A illustrates a weight member 2' made of a material of a different specific density. FIG. 4B illustrates a weight member 2" made of a material of another different specific density. Further, at least one resilient member 20" is fixed to an outer periphery of the weight member 2". The resilient member 20" is made of an elastic material and presses against the inner periphery delimiting the relatively larger outer section 143 of the compartment 14 to absorb vibrations resulting from striking a golf ball while preventing generation of odd sounds resulting from impact between the weight member 2 and the inner periphery delimiting the relatively larger outer section 143 of the compartment 14. It is noted that the resilient member 20" can be used on the weight member 2 for the iron club head in the first embodiment.

Figure 6:
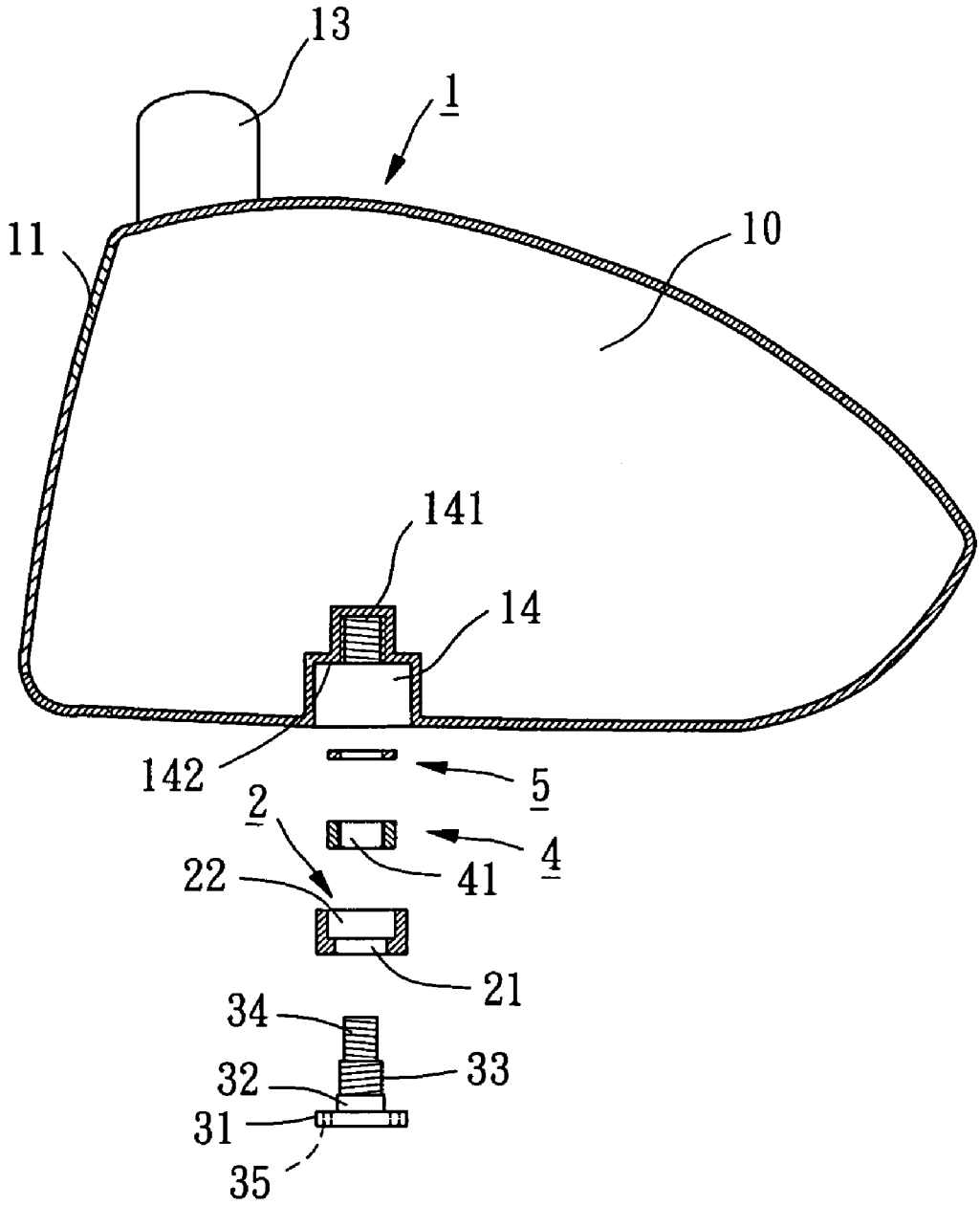
FIG. 6 is an exploded sectional view of a third embodiment of the club head in accordance with the present invention.
Figure 7:
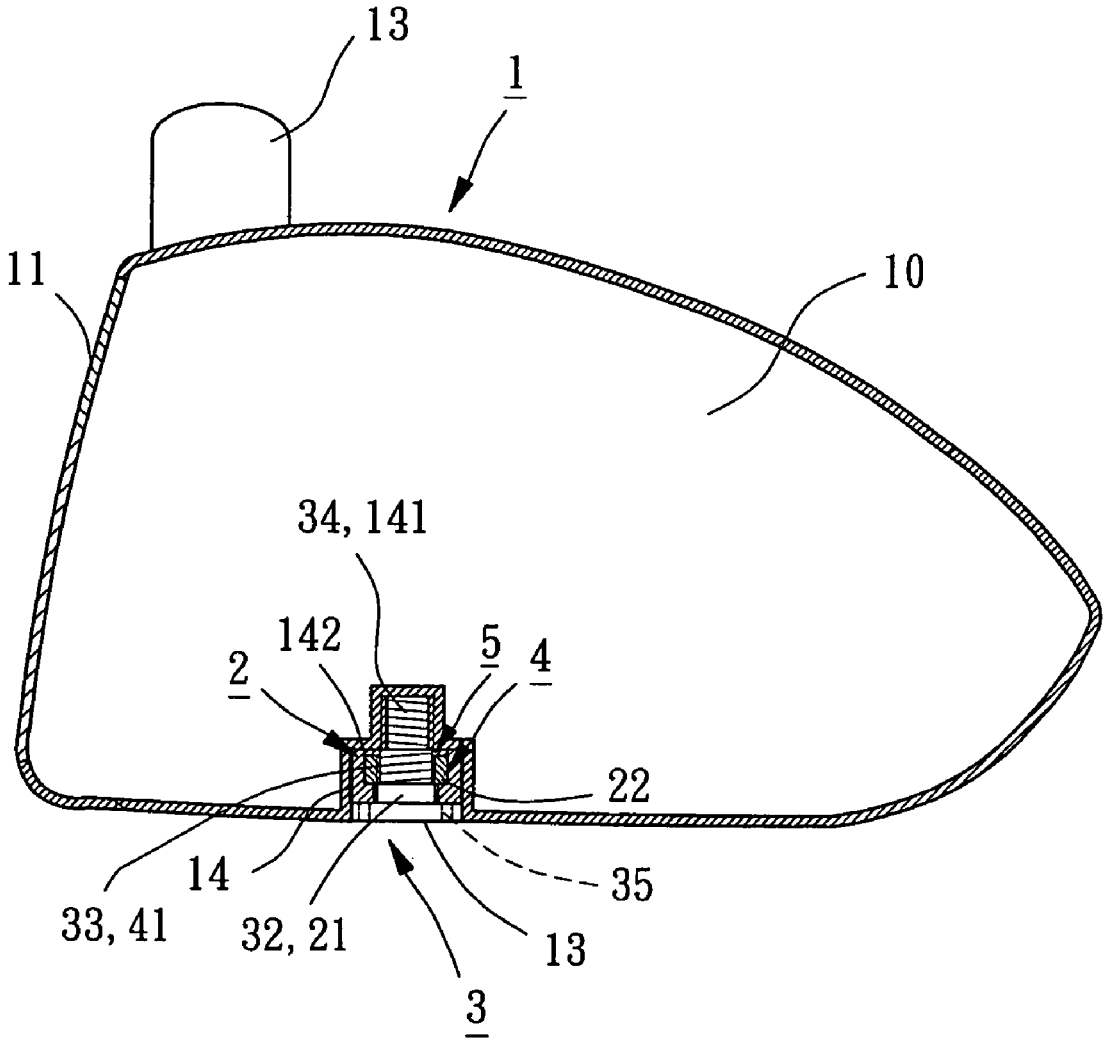
FIG. 7 is a sectional view of the club head in FIG. 6.

FIGS. 6 and 7 illustrate a third embodiment that is modified from the second embodiment, wherein a resilient washer 5 made of elastic material is received in the enlarged section 22 of the axial hole 21 of the weight member 2 and sandwiched between the shoulder 142 of the compartment 14 and the retaining member 4. The resilient washer 5 avoids disengagement of the retaining member 4 when striking a golf ball with the club head. Thus, the weight member 2, the positioning member 3, and the retaining member 4 are tightly engaged in the compartment 14. Further functions of the resilient washer 5 include absorbing vibrations resulting from the striking and avoiding generation of odd sounds during striking. It is noted that the resilient washer 5 can also be with the iron club head body 1 shown in FIG. 1.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A club head comprising:

a body including at least one compartment;

at least one positioning member removably mounted in said at least one compartment;

at least one weight member mounted in said at least one positioning member; and at least one retaining member for retaining said at least one weight member in said at least one positioning member, with said at least one weight member being concealed in said at least one compartment of the body;

wherein at least one weight member includes an axial hole having an enlarged section, said at least one retaining member being received in the enlarged section.

2. The club head as claimed in claim 1 wherein the body is an iron club head body including a back cavity, said at least one compartment being defined in a sole delimiting the back cavity.

3. The club head as claimed in claim 1 wherein the body is a wooden club head body including an inner space, said at least one compartment being defined in a sole delimiting the inner space.

4. The club head as claimed in claim 1 wherein said at least one retaining member is made of a material the same as that of the body.

5. The club head as claimed in claim 1 wherein said at least one positioning member includes a head for sealing said at least one compartment of the body.

6. The club head as claimed in claim 5 wherein the head of said at least one positioning member includes at least one driving portion for driving said at least one positioning member for mounting said at least one positioning member into said at least one compartment or removing said at least one positioning member from said at least one compartment.

7. The club head as claimed in claim 1 wherein said at least one positioning member comprises a shank including a first threaded section and a second threaded section.

8. The club head as claimed in claim 7 wherein said at least one retaining member includes a screw hole for threadedly engaging with the first threaded section.

9. The club head as claimed in claim 7 wherein said at least one compartment includes a threaded section for threadedly engaging with the second threaded section of said at least one positioning member.

10. The club head as claimed in claim 7 wherein the first threaded section has a lead different from that of the second threaded section.

11. The club head as claimed in claim 7 wherein the first threaded section has a diameter greater than that of the second thread section.

12. The club head as claimed in claim 1 wherein said at least one weight member further includes at least one resilient member fixed in an outer periphery of said at least one weight member and pressing against an inner periphery delimiting said at least one compartment for avoiding generation of odd sounds during striking.

13. The club head as claimed in claim 1 wherein the club head further comprises at least one resilient washer sandwiched between said at least one retaining member and an end face delimiting said at least one compartment.

14. The club head as claimed in claim 1 wherein said at least one compartment comprises a relatively larger outer section and a relatively smaller threaded inner section, forming a shoulder, said at least one positioning member comprising a shank including a first threaded section and a second threaded section, the second threaded section being threadedly engaged with the relatively smaller threaded inner section.

15. The club head as claimed in claim 14 wherein said at least one weight member further includes at least one resilient member fixed in an outer periphery of said at least one weight member and pressing against an inner periphery delimiting the relatively larger outer section of said at least one compartment for avoiding generation of odd sounds during striking.

16. The club head as claimed in claim 14 wherein said at least one retaining member including a screw hole for threadedly engaging with the first threaded section of said at last one positioning member.

17. The club head as claimed in claim 14 wherein said at least one weigh member includes an axial hole having an enlarged section, said at least one retaining member being received in the enlarged section.

18. The club head as claimed in claim 17 wherein the club head further comprises at least one resilient washer received in the enlarged section of the axial hole of said at least one weight member and sandwiched between said at least one retaining member and the shoulder.

19. The club head as claimed in claim 14 wherein said at least one positioning member includes a head for sealing said at least one compartment of the body, said shaft of said at least one positioning member extending from a side of the head.

* * * * *